US006745820B2

(12) United States Patent
Schivalocchi

(10) Patent No.: US 6,745,820 B2
(45) Date of Patent: Jun. 8, 2004

(54) COLD CHAMBER DIE-CASTING PISTON

(75) Inventor: Carlo Schivalocchi, Roe' Volciano (IT)

(73) Assignee: Copromec S.R.L., Roe' Volciano (IT)

( * ) Notice: Subject to any disclaimer, the term of this patent is extended or adjusted under 35 U.S.C. 154(b) by 0 days.

(21) Appl. No.: 10/151,837

(22) Filed: May 21, 2002

(65) Prior Publication Data

US 2003/0217830 A1 Nov. 27, 2003

(51) Int. Cl.[7] ..... B22D 17/08
(52) U.S. Cl. ..... 164/312; 164/113
(58) Field of Search ..... 164/312, 113

(56) References Cited

U.S. PATENT DOCUMENTS 5,048,592 A 9/1991 Mueller
5,350,007 A * 9/1994 Miki et al. ..... 164/316
2002/0092641 A1 * 7/2002 Koda et al. ..... 164/312

FOREIGN PATENT DOCUMENTS

JP 56-23360 * 3/1981
JP 9-70654 * 3/1997

* cited by examiner

*Primary Examiner*—Kuang Y. Lin
(74) *Attorney, Agent, or Firm*—McGlew and Tuttle, P.C.

(57) ABSTRACT

The finding relates to a piston for cold chamber die-casting machines that comprises a steel body and at least one sealing band in copper alloy mounted around the body into a respective housing in back position with respect to the piston head. At least two channels are provided on the outside surface of the piston comprised between head and sealing band, for an inflow on the melted metal under the same band. When such metal solidifies, it creates a thickness that radially pushes the band outwards, thus compensating for its wear.

12 Claims, 1 Drawing Sheet

COLD CHAMBER DIE-CASTING PISTON

SCOPE OF THE INVENTION

The present finding relates to die-casting machines. In particular, it refers to a piston of a press for die-casting.

PRIOR ART

Die-casting machines can be of the hot chamber or cold chamber type.

An injection piston is commonly used in hot chamber die-casting machines, having a steel body with sharp or slightly bevelled edge head carrying one or usually two copper alloy sealing bands spaced in parallel from one another and from the piston head.

In cold chamber die-casting machines, both the use of an injection piston with a copper alloy or steel body without outside sealing bands and with an optional peripheral head step and/or bevel, and the use of an injection piston with a copper alloy body and an outside sealing band arranged astride of a collar at the piston head, are known.

Such known embodiments, however, exhibit the disadvantage of a relatively quick loss of seal, and thus, a reduction of the piston efficiency and life following the wear, especially of the sealing band closer to the piston head, which is also increased by thermal deformations of the system, such as ovalization of the piston container. In this case, the seal can only be restored by replacing the worn band or bands.

PURPOSES AND SUMMARY OF THE FINDING

A purpose of the present finding is that of providing a piston for cold chamber die-casting which should be more efficient and with a longer life than the current ones, and which should thus allow reducing the operating costs of die-casting machines.

Another purpose of the finding is that of proposing a piston provided with sealing bands in copper alloy which, even though becoming worn, should be stressed to rearrange radially and conform to the thermal deformations, so as to not impair the piston life and efficiency.

Such purposes are achieved by a piston for cold chamber die-casting machines comprising a steel body having a head with or without peripheral bevel and at least one sealing band in copper alloy arranged around the body into a respective housing obtained in back position with respect to the head, and where at least two channels are obtained on the outside surface of the piston comprised between head and band, suitable for placing the piston head in communication with the annular housing of the band, for an inflow of metal under the same band.

In this way, when the metal flowing to the housing solidifies, it creates a continuous thickening which radially pushes the band outwards, thus progressively recovering its wear, conforming it to the possible deformations of the container of the piston and thereby protecting the latter.

BRIEF DESCRIPTION OF THE DRAWINGS

Further features of the finding shall appear more clearly from the following description, made with reference to the attached exemplificative and non-limiting drawings. In such drawings.

DETAILED DESCRIPTION OF THE INVENTION

Figure 2:
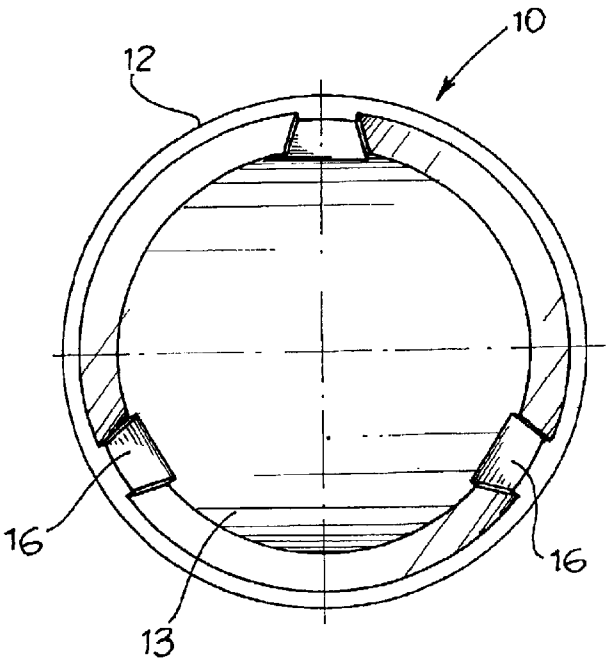
FIG. 2 shows a top view of the piston with compensation channels.
Figure 1:
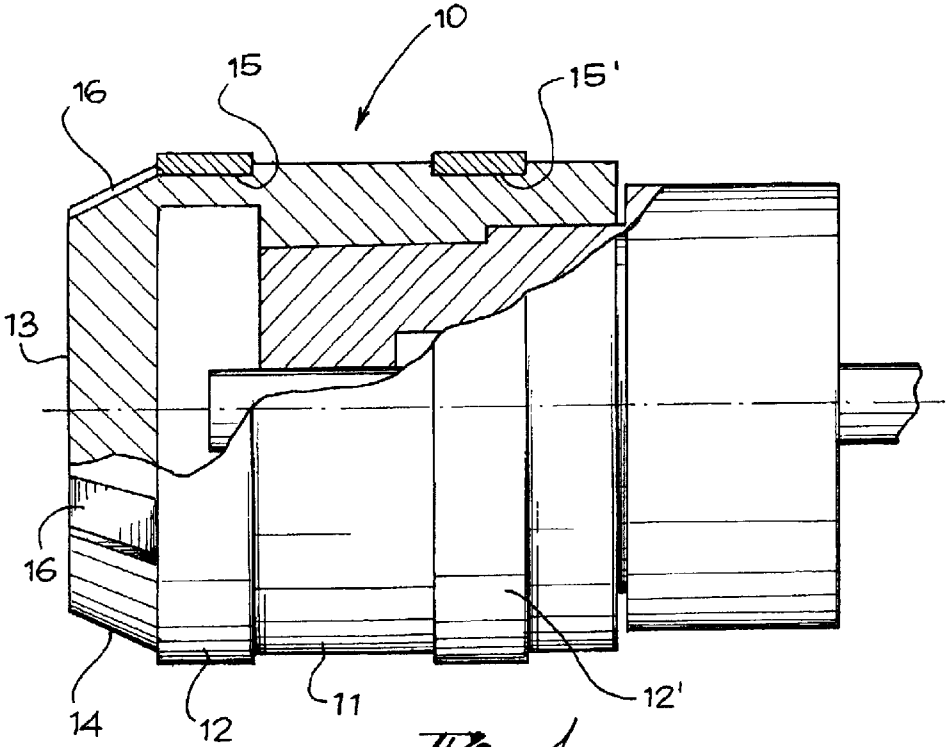
FIG. 1 shows a longitudinal section view of the piston according to the finding.

Said drawings show a piston 10 having a body 11 and at least one, or better two external sealing bands 12, 12', in copper alloy. The piston body has a head 13 orthogonal to the piston axis, which can be provided with a peripheral bevel 14, as in the illustrated example, or a sharp or rounded edge.

The sealing bands 12, 12' are arranged into respective housings 15, 15' obtained around body 11.

According to the finding, at least two channels 16 are obtained on the outside surface of the piston body comprised between head 13 and the band 12 closer to it, and they place the bottom of housing 15 of the band in communication with the piston head. Through said channels, the melted metal can flow into housing 15 under band 12, so as to create a continuous thickening that compensates for the band thinning caused by its wear following the use of the piston and the thermal deformations of its container.

In this way, the piston exhibits a longer seal and efficiency independently of the wear degree of the copper alloy band.

What is claimed is:

1. A cold chamber die-casting machine piston comprising:

a steel body with a piston head and with an outside surface a scaling band formed of a copper alloy, said sealing band being mounted around said body in a sealing band housing of said body and being disposed rearwardly with respect to said piston head; and two channels formed on the outside surface of said piston body between said piston head and said sealing band, said two channels placing said piston head in communication with said sealing band housing for an inflow of the melted metal under said sealing band whereby the metal under said band solidifies to create a thickness acting to push said sealing band radially outwards, thus compensating wear.

2. A piston according to claim 1, wherein said body has a peripheral bevel with a tapering of said body adjacent to said piston head and at a level of said channel.

3. A piston according to claim 1, wherein said body has a cylindrical peripheral surface at a level of said channel.

4. A piston according to claim 1, further comprising another outside sealing band, said another outside sealing band being spaced further from said piston head than said sealing band with said two channels extending from said piston bead to said sealing band.

5. A piston in cold chamber die-casting machines, the piston comprising:

a steel body with a piston head and with an outside surface defining a sealing band seal, said steel body having a chamber defined interiorly and spaced from said piston head and spaced from said outside surface;

a sealing band formed of a capper day, said sealing band being mounted around said body in said sealing band seat of said body and being disposed rearwardly with respect to said piston bead, a first channel recessed inwardly from said outside surface and extending from said piston head to said sealing band seat, said first channel placing said piston head in communication with said sealing band seat for an inflow of the melted metal under said sealing band; and a second channel recessed inwardly from said outside surface and extending from said piston head to said sealing band seat, said second channel placing said piston head in communication with said sealing band seat for an inflow of the melted metal under said sealing band whereby the metal under said band solidifies to create a thickness acting to push said sealing band radially outwards, thus compensating wear.

6. A piston according to claim 5, wherein said body has a peripheral bevel with a tapering of said body adjacent to said piston head and with a tapering of said body at a level of a surface of said channel.

7. A piston according to claim 5, wherein said body has a cylindrical peripheral surface at a level of a surface of said channel.

8. A piston according to claim 5, further comprising another outside scaling band, said another outside sealing band being spaced farther from said piston head than said sealing band with said first channel and maid second channel extending from said piston bead to said sealing band.

9. A cold chamber die-casting machine piston comprising:

a piston body with a piston head and with an outside peripheral surface and an annular sealing band housing recessed inwardly from said outside peripheral surface a first channel defining an outer surface recessed inwardly from said outside surface and extending from said piston head to said sealing band housing, said first channel placing said piston head in communication with said sealing band housing for an inflow of the melted metal under said sealing band, a second channel defining another outer surface recessed inwardly from said outside surface and extending from said piston head to said sealing band housing, said second channel placing said piston head in communication with said sealing band housing for an inflow of the melted metal under said scaling band and a channel or chamber defined interiorly and spaced from said piston head and spaced from said outside surface; and a sealing band formed of a copper alloy, said sealing band being mounted around said body in said sealing band housing of said body and being disposed rearwardly with respect to said piston head, the metal under said bed solidifying to create a thickness acting to push said sealing band radially outwardly and compensating wear.

10. A piston according to claim 9, wherein said piston body has a peripheral bevel with a tapering of said piston body adjacent to said piston bead and with a tapering of said piston body at a level of a surface of said channel.

11. A piston according to claim 9, wherein said piston body has a cylindrical peripheral suites at a level of a surface of said channel.

12. A piston according to claim 9, further comprising another outside sealing band, said another outside sealing bend being spaced thither from said piston head than said sealing band with said first channel and said second channel extending from said piston head to said sealing band.

* * * * *